US005375536A

United States Patent [19]

Peters

[11] Patent Number: 5,375,536

[45] Date of Patent: Dec. 27, 1994

[54] CHILD'S BED AND DRAWING TABLE

[76] Inventor: Treff Peters, 30 McGarry Street, Renfrew, Ontario, Canada, K7V 2M2

[21] Appl. No.: 22,959

[22] Filed: Feb. 25, 1993

[51] Int. Cl.[5] ..... A47F 5/12

[52] U.S. Cl. ..... 108/6; 108/23; 108/50; 312/231

[58] Field of Search ..... 108/6, 23, 9, 49, 50; 312/231

[56] References Cited

U.S. PATENT DOCUMENTS

| | | | |
|---|---|---|---|
| 2,285,576 | 6/1942 | Fox | 108/9 |
| 2,675,288 | 4/1954 | Usher | 108/9 |
| 2,688,818 | 9/1954 | Joy | 108/50 |
| 3,682,109 | 8/1972 | Gordon | 108/9 |

*Primary Examiner*—Kenneth J. Dorner
*Assistant Examiner*—Gerald A. Anderson
*Attorney, Agent, or Firm*—Bauer & Schaffer

[57] ABSTRACT

A simple and elegant activity center and drawing table is described; the preferred example is for children to use in bed, and consists of a drawing surface mounted on a rectangular frame, which is in turn supported on two boxes. The boxes sit on either side of the legs of a bed-ridden child, and are open on the sides for storage. Rolls of paper on either side of the drawing surface supply drawing paper; a window in the drawing surface and a gravity bar to hold a subject design allow tracing; and a latch-and-pivot behind the frame, in conjunction with hinges between the frame and boxes, allow the drawing surface to be raised to predetermined oblique angles. Alternatively, the surface may sit flat and be used as a table. A lip prevents crayons, pencils, or books from sliding off, and all parts near the front are rounded to prevent injury. All the described mechanisms can be easily manoeuvred by a child while in bed, without adult help.

16 Claims, 2 Drawing Sheets

CHILD'S BED AND DRAWING TABLE

INTRODUCTION AND DESCRIPTION OF THE PRIOR ART

One of the unavoidable experiences a young person must endure is illness: a child's immune system needs to encounter and overcome many types of diseases and infections. And it's best, of course, that the child remain in bed—or at least quietly occupied—while the brunt of such an attack is fended off. The invention to be described provides an efficient, simple, and enjoyable way for a child to organize his/her time while confined to bed, with minimum attention needing to be paid by adults beyond the unavoidable physical and emotional needs of the illness. As well, the invention may equally be used out of bed, and by children who are not ill at all, although certain features are especially applicable to the confined situation.

The available solutions to this problem are few, as is the prior art on the subject. U.S. Pat. No. 2,175,503, M. B. Cook, Drawing Table, is substantially different from what will be described here; it's a stand-alone device not meant for children or bed use. It has an adjustable drawing surface which is arranged so that it protrudes towards the user; in a room where one can move back from the table this is fine, but in a bed this would mean the body of the table would be too far away, so that moving the paper or retrieval of stored items—were there any storage space, which Cook's invention does not provide for—would be inconvenient if not impossible. Plus, the paper must be torn or cut off after each use; a mess—making and inconvenient aspect in a child-in-bed situation. And U.S. Pat. No. 2,285,576, E. Fox, Bed Easel Construction, is primarily concerned with adult invalids (or at least, no mention or special provision is made for children) and has no paper rolls and specifies large front legs in the form of top-opening pockets for storage space; these are to fit over the hips. Thus this prior art device must be especially large to accommodate the pockets'extension in front of the drawing board; it's confining, since the projections will go over the hips while the rest of the table fits over the legs; and it's inconvenient since the drawing papers used by the invalid must be kept elsewhere and moved into place singly. As well, the mechanism for changing the angle of display of the drawing surface involves a pin-on-a-chain mechanism that is likely to be beyond many young childrens'abilities—especially while ill.

The present invention in contrast provides a relatively small flat surface which a child may reach all of; an easy mechanism for changing the angle of the surface that requires only a simple pull into place; paper continuously and conveniently available on the surface, supplied by a roll at one side and wound after use onto a second roll at the other; and storage space, reachable by a child, at the side of a hollow box under each roll that also serves as the base for the entire device. There is also glass (or see-through plastic) set in the surface, so that light from behind may allow tracing; and a simple page holder so that a separate tracing page may be held between the transparent surface and the paper from the roll, no matter what the angle of the surface. A lip below the drawing surface stops pencils and crayons from rolling off and/or supports a book for reading when the surface is used in the upright position. When tracing is not undertaken and rolls of fully opaque paper, usable on both sides, are employed, the rolls may be easily and quickly reversed, even by a child, so that many days of paper are available before an adult needs to attend with more; and the rolls may be removed altogether if the table is also to be used as a bed-table, for instance at mealtimes.

An object of the present invention is to provide for a drawing-table primarily for use in bed, comprising: an oblong rectangular frame with differing long and wide dimensions; a drawing surface integral with this frame; a window set in the drawing surface to afford light for tracing; and two boxes, each of which is open on top and on the upper portion of one side so as to afford storage space inside the boxes. Further, the front of the frame is hingedly connected to the boxes, so that a gap exists between the two boxes wide enough to accommodate the legs of a person while the person is sitting or lying. Means of supplying blank drawing paper to the drawing surface and holding it on the surface are provided: as well as means of supporting the frame at an oblique angle, such that the back side of the frame is raised relative to the front side side of the frame.

It is also an object to provide for such a drawing-table comprising: a rectangular frame with two long and two short sides; a substantially flat rectangular drawing surface parallel to the frame and set centrally in it or moulded centrally integral with it; a transparent window set in the drawing surface; two substantially identical rectangular boxes, each of which is open on top and on the upper portion of one side: two sets of hinges, each set of which joins a front longer side of the frame with one upper edge of one box, such that the side of each box with the open upper portion runs parallel to and under a short side of the frame and such that a gap exists between the two boxes wide enough for the legs of a child to comfortably pass while the child is sitting or lying; means of supplying blank drawing paper to the drawing surface and holding it on the surface; means of holding a single sheet of paper in front of the transparent window and behind the blank drawing paper; means of supporting the frame at an oblique angle, such that a back side of the frame is parallel to and raised relative to the front side of the frame; and means of preventing round or cylindrical objects from rolling off, or books sliding off, the drawing surface. All edges near the front side of the frame are rounded so as not to cause injury or discomfort in use: the boxes, frame, and drawing surface are constructed or moulded of inexpensive and durable material such as wood or plastic; and all means recited are operable by a child of an appropriate for the size of the apparatus to fit: so that a child in bed may comfortably and easily be seated with his/her legs between the boxes and reach without moving, or fear of injury, to place or remove items from the boxes, place or remove a sheet of paper in front of the tracing window. move new blank drawing paper onto the drawing surface, remove used drawing paper, and change the angle of repose of the drawing surface relative to the boxes.

The means of supplying blank drawing paper to the drawing surface and holding it on the surface could consist in a long sheet of drawing paper wound into two rolls, one affixed parallel to and near each short side of the frame, such that a child may turn one of the rolls and pull blank paper across the drawing surface. The means of affixing and turning the rolls could consist in support cylinders passing within the rolls and handles on the ends of the support cylinders; the cylinders resting and turning freely in troughs formed in the long sides of the frame, so that it is possible for a child to lift out both rolls simultaneously and turn them over in order to use the back side of the long sheet of drawing paper.

It is also an object to provide for such an apparatus in which the means of supporting the frame at an oblique angle could consist in two longitudinally extensive members; a latch-rod seated in troughs on the upper surface of the wall of each box which faces the other box; the latch-rod joining the members; and two pivots attached behind the drawing surface, near the front side of the frame; one of which pivots attaches to that end of each member that is distant from the latch-rod; whereby a person, including a child whose legs are between the boxes, may reach under one or both members and pull them up, thereby pulling the latch-rod out of the troughs and allowing the members to turn on the pivots and the frame to turn on the hinges and be moved to a new angle of repose; the new angle to be fixed by placing the latch-rod into different troughs. A further function of the drawing-table could be as a bed-table, in which the frame sits horizontally and rests on ledges set in the tops of the boxes. The means of holding a single sheet of paper in front of the transparent window and behind the blank drawing paper could consist in a loose cylindrical bar contained by brackets at either end: the bar being pushed against the sheet of paper by gravity. Finally, the means of preventing round or cylindrical objects from rolling off the drawing surface or books from sliding off the drawing surface could consist in a lip rising from or near the edge of the drawing surface nearest the front side of the frame.

DETAILED DESCRIPTION OF THE INVENTION

Figure 1:
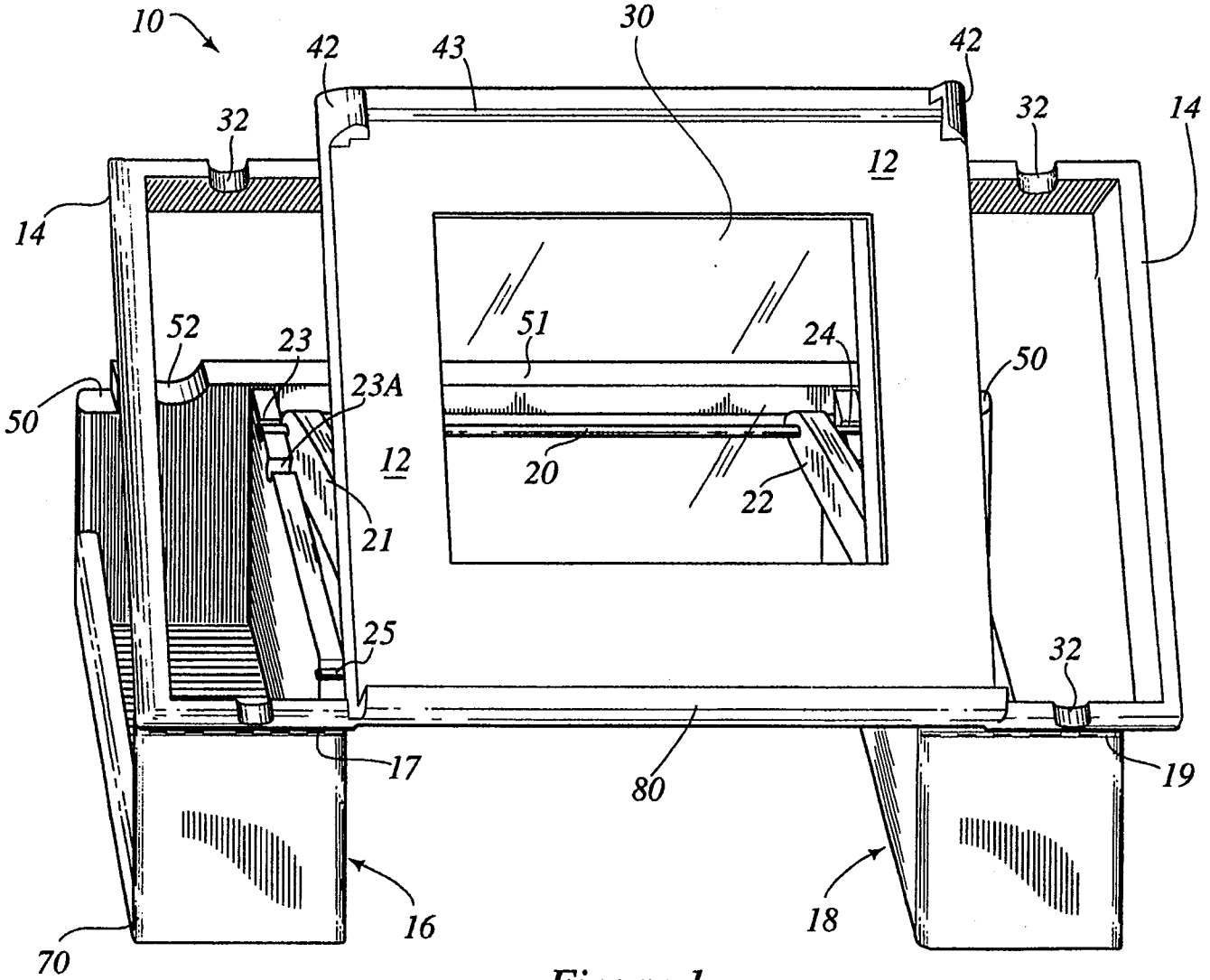
Figure 2:
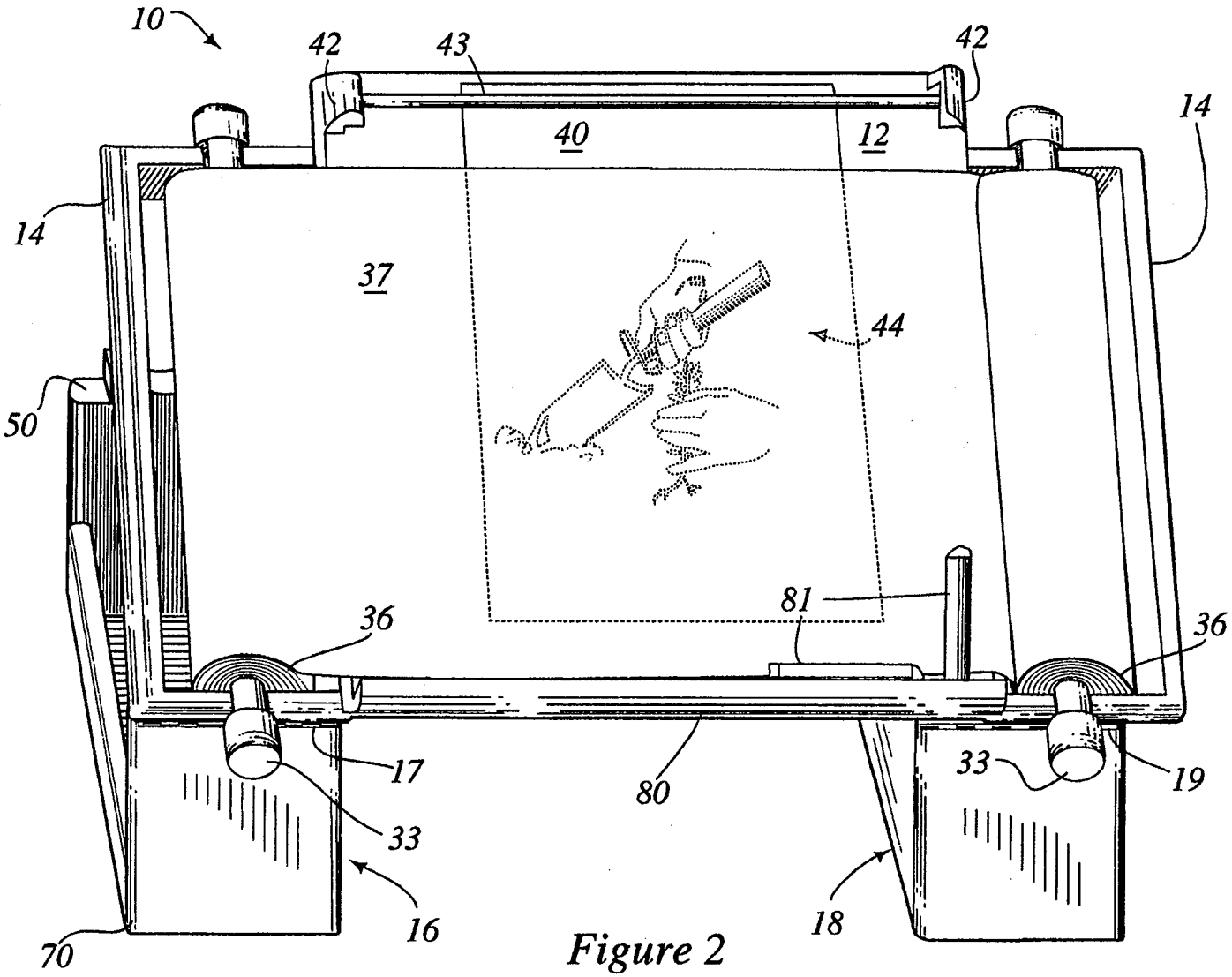

For this description, refer to the following diagrams, wherein like numerals refer to like parts:

FIG. 1, the preferred embodiment of the invented bed table, with top raised to oblique angle; perspective view: and FIG. 2, the perspective view of the FIG. 1, with the addition of rolled drawing papers and an example tracing page.

As can be seen with reference to FIG. 1, the invented drawing table generally indicated as 10 is primarily structurally composed of a drawing surface 12, a frame 14 supporting this surface, and two open boxes generally indicated as 16 and 18 which sit under and support frame 14. In the illustrated raised position this support is accomplished in part by hinges 17 and 19 on the respective boxes 16 and 18, and by adjustable latch-rod 20 which passes through support members 21 and 22 and into troughs 23 and 24 set into boxes 16 and 18 respectively. Another trough 23A is shown; more troughs could of course be formed in the device if desired, which would provide more angles that the drawing surface 12 could sit at.

Drawing table 10 as seen in FIG. 1 also includes window 30 set in surface 12, handle troughs 32 to accommodate handles 33 seen on FIG. 2 for paper rolls 36. As seen on FIG. 2, blank paper 37 from rolls 36 passes over tracing page 40, which has illustrative tracing drawing generally indicated as 44 shown in ghost lines. Tracing page 40 is held in place under paper 37 by gravity acting on pressure bar 43 set into angled brackets 42. Pressure-bar 43 may also be used to hold a piece of paper on surface 12, when paper rolls 36 are not employed.

Use of the table 10 is quite straightforward; child's play, one could say. The view of FIGS. 1 and 2 is the view seen by a child in bed; his/her legs (not shown) would pass between boxes 16 and 18. With reference to FIG. 2, it can be seen that paper 37 is continuously available from rolls 36, which can be advanced by turning handles 33. Removal of tracing page 40 simply involves pushing up on pressure bar 43 which will loosen page 40. To adjust surface 12 to another oblique angle, referring to FIG. 1, the user or another person merely reaches under one or both of support members 21 and 22 and pops them up (this is not shown in the Figures); then latch-rod 20 is placed into another trough, such as trough 23A; members 21 and 22 turn on pivot 25 attached to the rear of surface 12, and surface 12 pivots on hinges 17 and 19 and moves to a new angle. If it's desired that surface 12 be flat (horizontal), for instance to use drawing table 10 as a bed-table for eating or other functions, then support frame 14 is merely allowed to fall after members 21 and 22 are popped up. Frame 14 pivots again on hinges 17 and 19; in this case latch-rod 20 fits into a trough set into the back of surface 51. Cross-beam 12 (not shown) and frame 14 sits on top of ledge 50 and in back of cross-beam trough 52 provides sufficient space for paper rolls 36 to turn freely when surface 12 is being used in the described horizontal orientation (not illustrated).

Drawing table 10 may be moulded of some unibody material such as plastic, which would be extremely durable, lightweight, and inexpensive. However some users may prefer wood, and in some situations the extra weight such a configuration would entail might be preferred. It might be noted also that all surfaces that the user, likely a child, would encounter are smoothed or rounded; on FIG. 1, edge 70 of box 16, for instance, is so formed; so are many others (not numbered on the diagram).

Another useful and interesting feature is the storage function of the inner cavities of boxes 16 and 18: various tools, foods, knicknacks, and so forth could repose there (not shown). Finally, pencil lip 80 prevents pencils 81 and the like (seen on FIG. 2) from falling when surface 12 is in an oblique position; or may be used to support a book for reading.

It will be appreciated that this invention may also be used free-standing on a floor or table or other surface, and can be a useful activity center for children in non-illness situations; children may gather together, for instance, around a book propped up on the lip.

The foregoing is by example only, and the scope of the invention should be limited only by the appended claims.

The embodiments of the invention in which an exclusive property or privilege is claimed are defined as follows:

1. A drawing-table primarily for use in bed, comprising:

a pair of storage boxes spaced from each other to permit a person's legs to fit therebetween, each box being open at at least its top for access into said box, a rectangular frame hingedly connected along one of its long edges to the front edge of said boxes, a drawing table mounted on said frame, said drawing table being provided with a light window for tracing, means for supplying blank drawing paper to the drawing surface and for holding it on said surface;

means for supporting the frame at an angle to the top of said boxes such that the back edge of the frame is raised above said front edge of the frame, and means for holding a single sheet of paper in front of the light window and behind the blank drawing paper, comprising a loose cylindrical bar held at either end by brackets attached to said frame and pushed against the sheet of paper by gravity; and a lip rising adjacent the edge of the drawing surface nearest the front edge of the frame to prevent round or cylindrical objects from rolling off the drawing surface or books from sliding off the surface.

2. An apparatus as in claim 1, in which the means of supplying blank drawing paper consists of a long sheet of drawing paper wound into two rolls, one affixed parallel to and near each short side of the rectangular frame.

3. An apparatus as in claim 2, in which the apparatus is primarily to be used by children, and in which all edges near the front side of the frame are rounded so as not to cause injury or discomfort in use; and wherein all means recited are operable by a child of an age appropriate for the size of the apparatus.

4. An apparatus as in claim 2, in which the means for affixing and turning said rolls comprises support cylinders passing within the rolls, and in handles on the ends of the support cylinders; said cylinders or handles resting and turning freely in troughs formed near each end of the frame.

5. An apparatus as in claim 4, in which the apparatus is primarily to be used by children, and in which all edges near the front side of the frame are rounded so as not to cause injury or discomfort in use; and wherein all means recited are operable by a child of an age appropriate for the size of the apparatus.

6. An apparatus as in claim 1, in which said drawing-table serves as a bed-table, wherein the frame is horizontally supported on ledges formed in the top of one wall of each box.

7. An apparatus as in claim 1, in which the apparatus is primarily to be used by children, and in which all edges near the front side of the frame are rounded so as not to cause injury or discomfort in use; and wherein all means recited are operable by a child of an age appropriate for the size of the apparatus.

8. An apparatus as in claim 1, in which the means for supporting the frame at an angle comprises members attached at one end to a latch-rod seated in troughs formed in the top of one wall of each box and hingedly connected at the other end to the frame or drawing surface.

9. An apparatus as in claim 8, in which the apparatus is primarily to be used by children, and in which all edges near the front side of the frame are rounded so as not to cause injury or discomfort in use; and wherein all means recited are operable by a child of an age appropriate for the size of the apparatus.

10. A drawing-table for use by children in bed, comprising:

a rectangular frame with two long and two short sides;

a substantially flat rectangular drawing surface parallel to the frame and set centrally within said frame or moulded centrally integral within said frame;

a transparent window set in the drawing surface;

two substantially identical rectangular boxes, each of which is open on top and on the upper portion of one side;

two sets of hinges, each set of which joins a front longer side of the frame with one upper edge of one box, such that the side of each box with said open upper portion runs parallel to and under a short side of the frame, and such that a gap exists between the two boxes wide enough for the legs of a child to comfortably pass while the child is sitting or lying;

means of supplying blank drawing paper to the drawing surface and holding it on said surface;

means of holding a single sheet of paper in front of the transparent window and behind the blank drawing paper;

means of supporting the frame at an oblique angle, such that a back side of the frame is parallel to and raised relative to said front side of the frame; and means of preventing round or cylindrical objects from rolling off the drawing surface, or books from sliding off the drawing surface;

wherein all edges near the front side of the frame are rounded so as not to cause injury or discomfort in use;

wherein the boxes, frame, and drawing surface are constructed or moulded of inexpensive and durable material such as wood or plastic;

and whereby a child in bed may comfortably and easily be seated with his/her legs between said boxes and reach without moving, or fear of injury, to place or remove items from the boxes, place or remove a sheet of paper in front of the tracing window, move new blank drawing paper onto the drawing surface, remove used drawing paper, and change the angle of repose of the drawing surface relative to the boxes.

11. An apparatus as in claim 10, in which the means of supplying blank drawing paper to the drawing surface and holding it on said surface consists in a long sheet of drawing paper wound into two rolls, one affixed parallel to and near each short side of the frame, such that a child may turn one of said rolls and pull blank paper across the drawing surface.

12. An apparatus as in claim 11, in which the means of affixing and turning said rolls consists in support cylinders passing within the rolls and handles on the ends of the support cylinders; said cylinders resting and turning freely in troughs formed in the long sides of the frame, so that it is possible for a child to lift out both rolls simultaneously and turn them over in order to use the back side of the long sheet of drawing paper.

13. An apparatus as in claim 10, in which the means of supporting the frame at an oblique angle consists in two longitudinally extensive members;

a latch-rod seated in troughs on the upper surface of the wall of each box which faces the other box; said latch-rod joining said members; and two pivots attached behind the drawing surface, near the front side of the frame; one of which pivots attaches to that end of each member that is distant from the latch-rod;

whereby a person, including a child whose legs are between the boxes, may reach under one or both members and pull them up, thereby pulling the latch-rod out of the troughs and allowing the members to turn on the pivots and the frame to turn on the hinges and be moved to a new angle of repose;

said new angle to be fixed by placing the latch-rod into different troughs.

14. An apparatus as in claim 10, in which a further function of the drawing-table is as a bed-table, in which the frame sits horizontally and rests on ledges set in the tops of the boxes.

15. An apparatus as in claim 10, in which the means of holding a single sheet of paper in front of the transparent window and behind the blank drawing paper consists in a loose cylindrical bar contained by brackets at either end; said bar being pushed against the sheet of paper by gravity.

16. An apparatus as in claim 10, in which the means of preventing round or cylindrical objects from rolling off the drawing surface, or books from sliding off the drawing surface, consists in a lip rising from or near the edge of the drawing surface nearest the front side of the frame.

* * * * *